US006406258B1

(12) United States Patent
Lin et al.

(10) Patent No.: US 6,406,258 B1
(45) Date of Patent: Jun. 18, 2002

(54) FAN FRAME STRUCTURE

(75) Inventors: Tsu-liang Lin; Kuo-cheng Lin; Wen-shi Huang, all of Taoyan (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 09/693,683

(22) Filed: Oct. 19, 2000

(30) Foreign Application Priority Data

Jun. 16, 2000 (TW) ..... 89210427 U

(51) Int. Cl.[7] ..... F04D 29/66

(52) U.S. Cl. ..... 415/213.1; 415/208.5; 415/214.1; 415/223

(58) Field of Search ..... 415/213.1, 186, 415/214.1, 121.2, 208.1, 208.3, 208.5, 220, 223; 416/247 R

(56) References Cited

U.S. PATENT DOCUMENTS

| | | | | |
|---|---|---|---|---|
| 5,288,203 A | * | 2/1994 | Thomas | 415/213.1 |
| 5,407,324 A | * | 4/1995 | Starnes, Jr. et al. | 415/214.1 |
| 5,421,402 A | * | 6/1995 | Lin | 165/80.3 |
| 5,615,998 A | * | 4/1997 | Kodama et al. | 415/213.1 |
| 5,707,205 A | * | 1/1998 | Otsuka | 415/214.1 |

* cited by examiner

*Primary Examiner*—Edward K. Look
*Assistant Examiner*—Richard Woo
(74) *Attorney, Agent, or Firm*—Martine & Penilla, LLP

(57) ABSTRACT

A fan frame for encircling an impeller of a fan that includes a base and a plurality of teeth. A hole is formed on the base to form an inner periphery. The plurality of teeth is substantially perpendicular to, and mounted around the inner periphery for encircling the impeller of the fan. A plurality of clearances is formed between each one of the plurality of teeth and its adjacent tooth.

2 Claims, 3 Drawing Sheets

FAN FRAME STRUCTURE

BACKGROUND OF THE INVENTION

1. Field of the Invention

The invention relates to a fan frame structure, in particular, to a fan frame structure having a plurality of clearances to increase the side-airflow of the fan.

2. Description of the Related Art

With the growth in the development of electrical products, the radiation performance of the fan has become an important subject matter. FIG. 5 is a pictorial view showing a conventional fan structure. Referring to FIG. 5, the fan includes a fan frame 100 and an impeller 200. The impeller 200 is located in the fan frame 100. An inlet 101 and an outlet 102 are formed on the fan frame 100 for the air to flow in and out, respectively.

In the above-mentioned fan, it is preferred that the inlet 101 is as large as possible. Thus, if the area of the inlet 101 is increased or extra inlets are added, the airflow from the fan can be increased to improve the radiation performance of the fan.

SUMMARY OF THE INVENTION

It is therefore an object of the invention to provide a fan frame structure having a plurality of clearances so as to increase the side airflow into the fan.

According to one aspect of the invention, a fan frame for encircling an impeller of a fan includes a base and a plurality of teeth. A hole is formed in the base to form an inner periphery. The plurality of teeth is substantially perpendicular to and mounted around the inner periphery for encircling the impeller of the fan. A plurality of clearances is formed between each one of the pluralities of teeth and its adjacent tooth.

According to the above-mentioned structure, the plurality of clearances can increase the inlet area of side airflow to improve the performance of the fan.

The fan frame may further include a motor mounting plate located at the center of the hole, and a plurality of ribs connecting the inner periphery of the base to the motor mounting plate for holding the motor mounting plate.

In addition, each of the plurality of teeth is arranged along, and is parallel to, or not parallel to, a tangent of the inner periphery.

DETAILED DESCRIPTION OF THE INVENTION

The preferred embodiments of the invention will be described in detail with reference to the accompanying drawings.

1. First Embodiment

Figure 1:
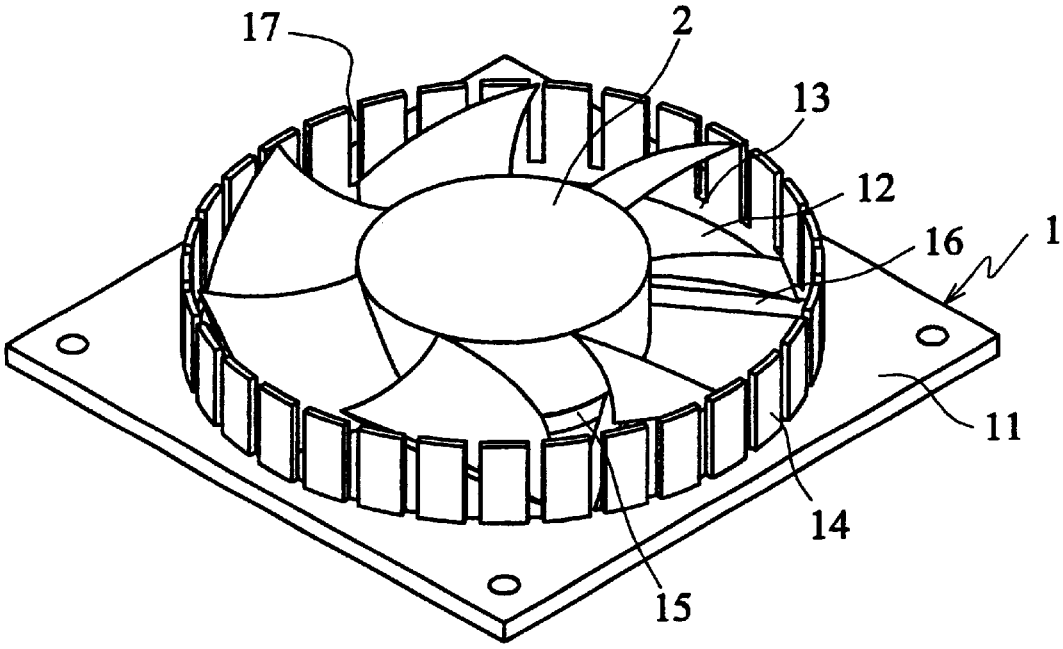
FIG. 1 is a pictorial view showing a fan frame and an impeller in accordance with the first embodiment of the invention.
Figure 2:
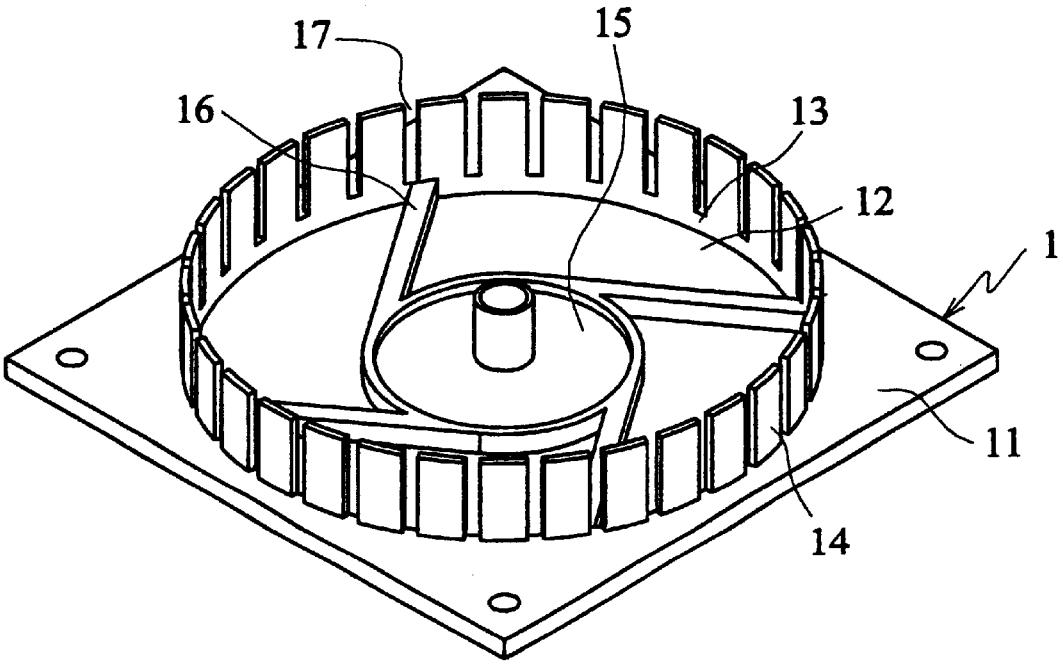
FIG. 2 is a pictorial view showing the fan frame as shown in FIG. 1.

FIG. 1 is a pictorial view showing a fan frame and an impeller in accordance with the first embodiment of the invention. FIG. 2 is a pictorial view showing the fan frame as shown in FIG. 1. Referring to FIGS. 1 and 2, the fan frame 1 in accordance with the first embodiment of the invention is used for encircling the impeller 2 of the fan. The fan frame 1 includes a base 11, a hole 12, a plurality of teeth 14, and a motor mounting plate 15.

A hole 12 is formed in the base 11 to form an inner periphery 13. A plurality of teeth 14 is substantially perpendicular to, and arranged around, inner periphery 13 to encircling the impeller 2. A clearance 17 is formed between each two adjacent teeth 14 and functions as an extra inlet of the fan. A plurality of ribs 16 connects the inner periphery 13 of the base 11 to the motor mounting plate 15 for mounting purposes.

Optionally, any two or more of the motor mounting plate 15, the ribs 16, the teeth 14, and the base 11 can be integrally formed.

In this embodiment, it should be noted that every tooth 14 is arranged along and parallel to a tangent of the inner periphery 13.

In comparison with the prior art, the fan frame 1 in accordance with the embodiment not only protects the impeller 2, but also increases the side area of the side airflow for increasing the airflow from the fan.

2. Second Embodiment

Figure 3:
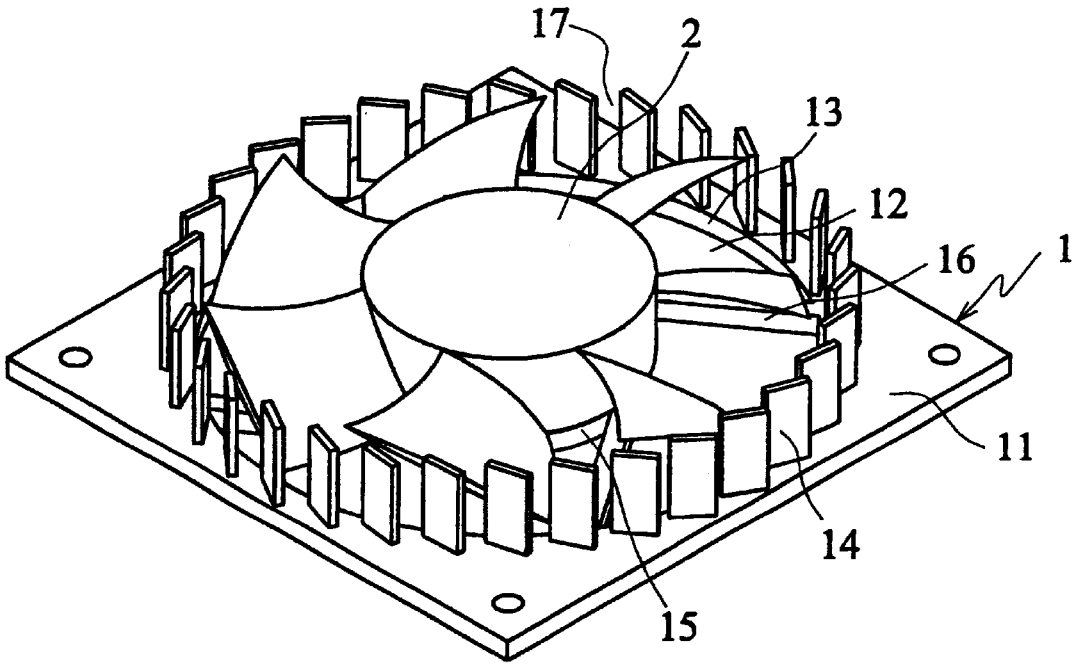
FIG. 3 is a pictorial view showing a fan frame and an impeller in accordance with the second embodiment of the invention.
Figure 4:
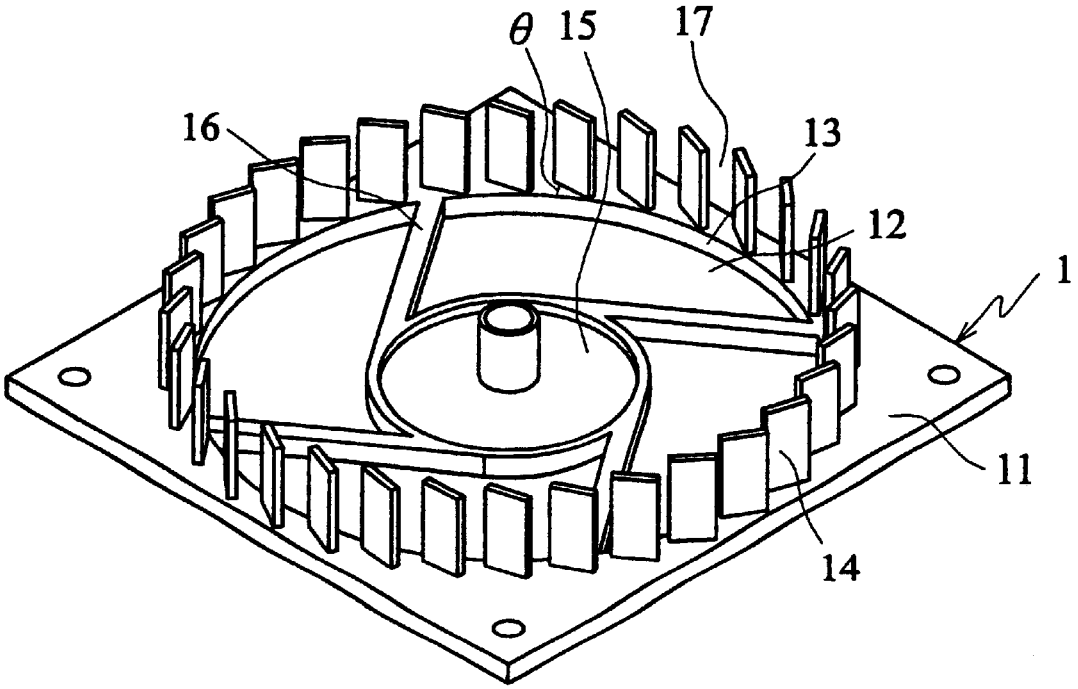
FIG. 4 is a pictorial view showing the fan frame as shown in FIG. 3.
Figure 5:
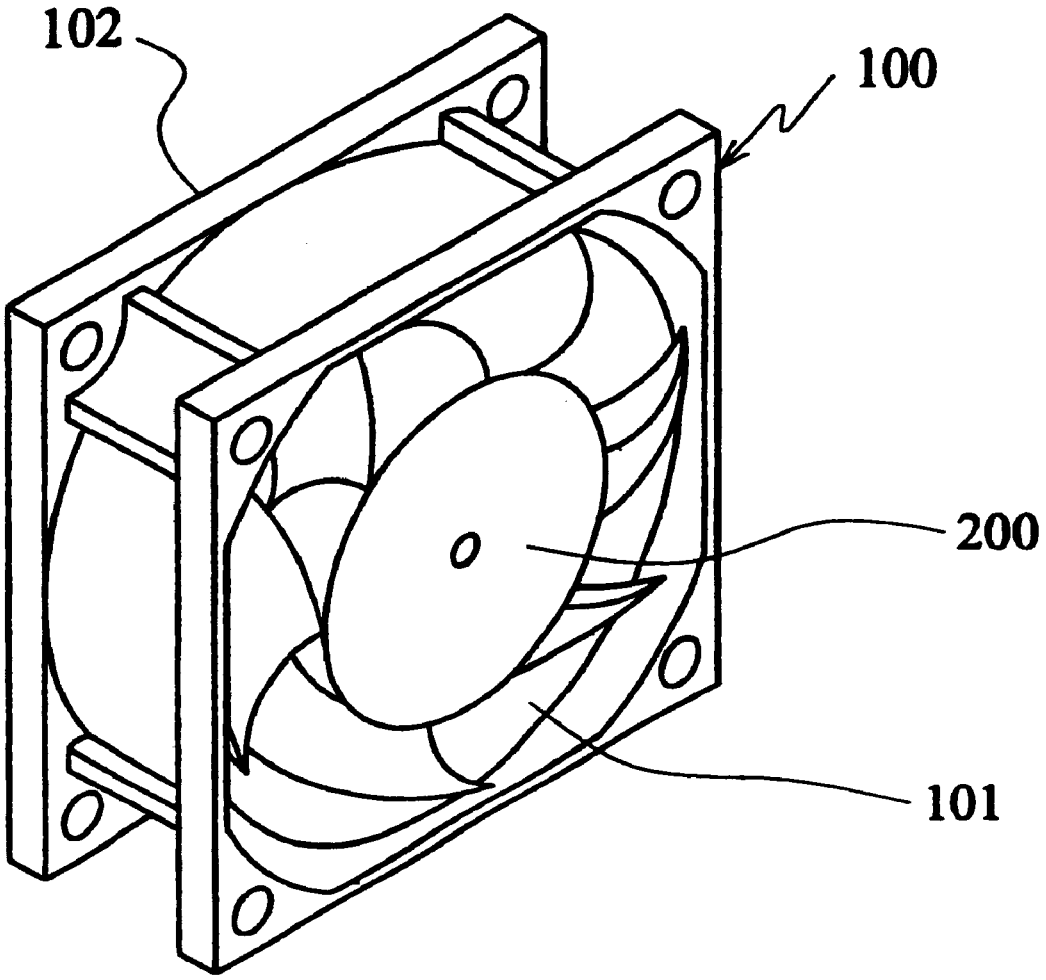
FIG. 5 Prior Art
FIG. 5 is a pictorial view showing a conventional fan.

FIG. 3 is a pictorial view showing a fan frame and an impeller in accordance with the second embodiment of the invention. FIG. 4 is a pictorial view showing the fan frame as shown in FIG. 3. Referring to FIGS. 3 and 4, the fan frame 1 in accordance with the second embodiment of the invention is used for encircling an impeller 2 of the fan. The fan frame 1 includes a base 11, a hole 12, a plurality of teeth 14, and a motor mounting plate 15.

A hole 12 is formed on the base 11 to form an inner periphery 13. A plurality of teeth 14 is substantially perpendicular to and arranged around inner periphery 13 to encircle the impeller 2. A clearance 17 is formed between each two adjacent teeth 14 and functions as an extra inlet for the fan. A plurality of ribs 16 connects the inner periphery 13 of the base 11 to the motor mounting plate 15 for holding it.

Optionally, any two or more of the motor mounting plate 15, the ribs 16, the teeth 14, and the base 11 can be integrally formed.

In this embodiment, it should be noted that every tooth 14 is arranged along and not parallel to a tangent of the inner periphery 13. In this case, an angle $\theta$ (from 0 to 90 degrees) is formed between every tooth 14 and the tangent of the inner periphery 13.

In this embodiment, it should be noted that every tooth 14 is not parallel to the inner periphery 13. In this case, an angle $\theta$ (from 0 to 90 degrees) is formed between every tooth 14 and the inner periphery 13.

In comparison with the prior art, the fan frame 1 in accordance with the embodiment not only protects the impeller 2, but also increases the side area of the side airflow and increases the airflow from the fan. Alternatively, in comparison with the first embodiment, the advantage of the embodiment is that the clearances 17 serve as extra inlets for the fan and can be best designed according to the property and the rotating direction of the impeller 2.

While the invention has been described by way of example and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications. For instance, a fan frame without a plurality of ribs 16 and a motor mounting plate 15 may be produced to cover the fan mounted on a base (not shown) to protect the impeller and increase the inlet area of airflow.

What is claimed is:

1. A fan frame for encircling an impeller of a fan, comprising:

a base on which a hole is provided to form an inner periphery; and a plurality of teeth which is integrally formed on the base and extending substantially perpendicular to and mounted around said inner periphery for encircling said impeller of said fan, a plurality of clearances being formed between each one of said plurality of teeth, wherein each one of said plurality of teeth substantially has the same width and height.

2. The fan frame according to claim 1, further comprising:

a motor mounting plate located at the center of said hole; and a plurality of ribs connecting said inner periphery of said base to said motor mounting plate for holding said motor mounting plate.

* * * * *